US009064390B1

(12) United States Patent
Clark

(10) Patent No.: US 9,064,390 B1
(45) Date of Patent: Jun. 23, 2015

(54) SYSTEM AND METHOD FOR A NOVELTY MOOD SENSING SHARING DEVICE

(71) Applicant: Anthony L. Clark, Saratoga, CA (US)

(72) Inventor: Anthony L. Clark, Saratoga, CA (US)

( * ) Notice: Subject to any disclaimer, the term of this patent is extended or adjusted under 35 U.S.C. 154(b) by 0 days.

(21) Appl. No.: 14/499,159

(22) Filed: Sep. 27, 2014

(51) Int. Cl.
*G08B 23/00* (2006.01)
*G08B 5/36* (2006.01)

(52) U.S. Cl.
CPC ..... *G08B 5/36* (2013.01)

(58) Field of Classification Search
CPC ..... G05B 15/02; G05B 19/042; G05B 2219/25323; G05B 2219/2613; G05B 2219/2615; G05B 2219/34038; G05B 19/0426; G05B 2219/23021; G05B 2219/23026; G06Q 30/02; G06Q 30/0248; G06Q 30/0255
USPC ..... 340/573.1, 568.8, 573.2, 573.3, 576, 340/640, 643, 665, 682, 683, 686.5, 340/5.91–5.92, 825.49
See application file for complete search history.

(56) References Cited

U.S. PATENT DOCUMENTS

| | | | | |
|---|---|---|---|---|
| 3,585,381 | A | 6/1971 | Bellbrook et al. | |
| 3,720,623 | A | 3/1973 | Cartmell et al. | |
| 3,802,945 | A | 4/1974 | James | |
| 3,951,133 | A | 4/1976 | Reese | |
| 4,220,016 | A * | 9/1980 | Frenger | 63/14.9 |
| 4,747,413 | A | 5/1988 | Bloch | |
| 6,675,744 | B1 * | 1/2004 | Levan | 119/858 |
| 2007/0266479 | A1 * | 11/2007 | Lanzo | 2/400 |
| 2009/0002178 | A1 * | 1/2009 | Guday et al. | 340/573.1 |
| 2010/0069724 | A1 * | 3/2010 | Leuthardt et al. | 600/301 |
| 2011/0245633 | A1 * | 10/2011 | Goldberg et al. | 600/301 |

* cited by examiner

*Primary Examiner* — Daniel Previl

(57) ABSTRACT

The present disclosure pertains to a mood sensing sharing device, suitable for decorative jewelry, which enables the sharing of an included mood stone's indicated emotions over a communications network.

5 Claims, 5 Drawing Sheets

SYSTEM AND METHOD FOR A NOVELTY MOOD SENSING SHARING DEVICE

CROSS-REFERENCE TO RELATED APPLICATIONS

This application is related to and claims priority from U.S. Provisional Application No. 61/998,530, titled "System and Method for a Novelty Mood Sensing Sharing Device,' filed Jul. 1, 2014, the entire contents of which are incorporated herein by reference.

STATEMENT REGARDING FEDERALLY SPONSORED RESEARCH OR DEVELOPMENT

Not Applicable.

REFERENCE TO COMPACT DISC APPENDIX

Not Applicable.

BACKGROUND OF THE INVENTION

This invention relates to the novel sharing of the color of a mood stone adorned device utilizing a communications network. A system and method for sharing indications of emotion between a mood sensing sharing device and a mobile communications apparatus are provided.

Contemporary thermochromic liquid crystals, including those used clinically in thermometers and those used in mood stone adorned jewelry, differ only slightly from the temperature sensitive cholesteric liquid crystals devices fabricated and refined in the 1960s and 1970s. Today's marketed thermochromic liquid crystals (TLC) owe their existence, in part, to the pioneering teachings of Donald Churchill, James V. Cartmell, and Robert Miller in U.S. patent application Ser. No. 618,751 (Feb. 27, 1967), which conveys how the encapsulation of cholesteric liquid crystals protects the liquid crystals from degraded color-scattering as a consequence of exposure to dust, moisture, and other debasing substances over time. The same trio later combined with Theodore L. Hodson Bellbrook, U.S. Pat. No. 3,585,381 (Apr. 14, 1969) to refine the manufacture of encapsulated cholesteric liquid crystal displays, which involves adding a smooth transparent surface layer on top of and in direct contact with the liquid crystal layer to impart improved color purity and contrast qualities. Further improvements to color brightness and to lifetime, through the mixing of nematic liquid crystals with cholesteric liquid crystals, were contributed by Cartmell et al., U.S. Pat. No. 3,720,623 (Mar. 13, 1973). With the foundation laid, new applications of TLC emerged, including decorative cholesteric stones, i.e., mood stones, U.S. Pat. No. 3,802,945; clinical thermometers, U.S. Pat. Nos. 3,951,133 and 4,747,413; decorative animal collars with mood stones, U.S. Pat. No. 6,675,744; and skin jewelry consisting of mood stones that can be attached to the skin by means of an adhesive layer, U.S. Pat. No. 4,220,016. However, none of these mood stone implements embody a means for sharing the color state of the mood stone over a communications network.

The first mood rings were marketed in the early 1970s. Color changes in the stone of a mood ring, a mood bracelet, or other piece of mood stone adorned jewelry are believed to be related to changes in a wearer's mood—which is thought to be correlated with changes in the wearer's skin temperature. An included TLC layer, which comprises encapsulated cholesteric liquid crystals, is the mechanism that produces a change in the color displayed on the mood stone commensurate with a change in skin temperature. More specifically, the color-scattering, i.e., reflective properties of the TLC layer vary with temperature. This means that different light waves (i.e., colors) will be reflected in the mood stone as the wearer's skin temperature changes.

Typically, the visible color band of the TLC layer is formulated to range from gray at the lowest measurable skin temperature (corresponding to a tense mood), to green for a normal skin temperature (corresponding to a relaxed mood), and to dark blue for the highest measurable skin temperature (corresponding to a happy, passionate mood); though some mood stones use different liquid crystals which exhibit other colors in response to changes in the heat transferred from the skin to the mood stone. Temperatures below the lower bound of the range and above the upper bound of the range for the TLC layer are shown as black.

All prior art mood stone adorned jewelry, whether in the setting of a ring, in the setting of bracelet, in the setting of pendant, or in any other setting, require that an observer of the color of the mood stone be within eyesight distance from the mood stone to view the color. Furthermore, all prior art mood stone adorned jewelry lack an apparatus, a means, or both to share the color of a mood stone therein, corresponding to the mood of the wearer, with other interested observers who are out of eyesight distance from the mood stone. As the sharing of mood is highly desirable, regardless of the location of the person or persons with whom one wishes to socialize, the lack of a mood sharing capability, which is independent of physical location, is a limitation of all prior art mood stone jewelry.

An objective of the present invention is overcome this limitation of prior art mood stone jewelry, by providing a sharing means for the color of a mood stone, which is independent of the location of interested observers (i.e., contacts).

This invention has other advantageous objects and features which will be apparent from following. It should be understood that the invention is not limited to the embodiments illustrated and described, as it may be varied within the scope of the appended claims.

SUMMARY OF THE INVENTION

This invention relates to the novel sharing of the color of a mood stone adorned device utilizing a communications network. In particular, a system and method for sharing indications of emotion between a mood sensing sharing device and a mobile communications apparatus are provided. A mood sensing sharing device within a mood sensing sharing system enables mood sharing regardless of the physical locations of the interested contacts, or mobile communications apparatuses.

An objective of this invention is to provide a new type of mood sensing and sharing jewelry (for example, in the form of a ring, an earring, a bracelet, et cetera) which enables the sharing of the color of a mood stone therein, corresponding to the emotional state of the wearer, over a communications network.

It should be understood that the invention is not limited to the embodiments illustrated and described, as it may be varied within the scope of the appended claims.

In one embodiment of this invention, a mood sensing sharing system comprises a mood sensing sharing device, a paired mobile communications apparatus, at least one communications network, and one or more selected other communications apparatuses.

A mood sensing sharing device comprises a mood stone, an optional insulator and an electronics subsystem. The mood stone is of a type taught by U.S. Pat. No. 3,802,945. The insulator comprises an insulating material such as rubber, to help thermally isolate the mood stone from the electronics subsystem. The electronics subsystem of a mood sensing sharing device enables the color being displayed on the mood stone, reflecting the wearer's mood, to be shared with at least one mobile communications apparatus over a communications connection. The electronics subsystem of a mood sensing sharing device comprises at least one sensor, which in one embodiment of this invention is a temperature sensor. Because a mood stone exhibits temperature dependent iridescence, a temperature reading from the aforementioned temperature sensor can be mapped to the mood stone's color. Other embodiments of the electronics subsystem may contain other sensors which individually, or in combination are used to record the color of a mood stone (and hence record a wearer's emotional state).

A smart phone, laptop computer, and tablet computer are all examples of mobile communications apparatuses, which are capable of executing a custom application according to the present invention. In one embodiment of this invention, after receiving a new message containing color information from a mood sensing sharing device, a conforming custom application compares the received color to the previously received color to determine if the new color is different, reflecting a change in the wearer's mood. In such an event, the custom application of the mobile communications apparatus may further share the mood stone's new color (along with an optional text message) with a select group of one or more contacts via their communications apparatuses. Of course, variations of this exemplary method, which are within the scope of the appended claims, are possible.

DESCRIPTION OF THE PREFERRED EMBODIMENTS

This invention relates to the novel sharing of the color of a mood stone utilizing a communications network. A system and method for sharing indications of emotion between a mood sensing sharing device and a mobile communications apparatus are provided. Mood sharing is enabled regardless of the physical locations of the mood sensing sharing device and mobile communications apparatuses.

Figure 1:
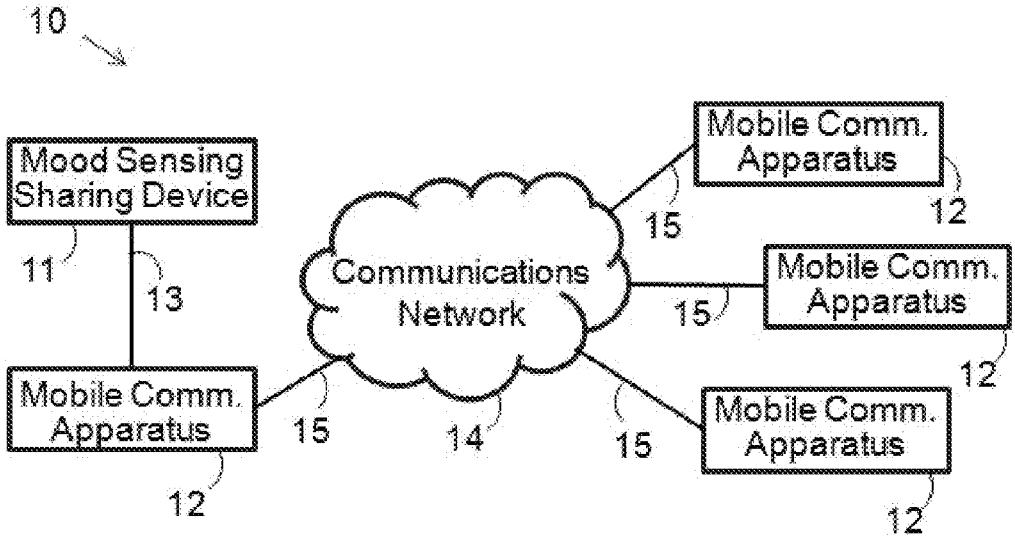
FIG. 1 is a block level diagram of a mood sensing sharing system.

Referring to FIG. 1, there shown is a block level illustration of a mood sensing sharing system 10, which is constructed in accordance with the present invention. A mood sensing sharing device 11 is illustrated in communication with a mobile communications apparatus 12 via a communications connection 13. Mobile communications apparatuses 12 further communicate with other mobile communications apparatuses 12 by means of a communications connection 15 and via communications network 14.

A mood sensing sharing device 11 comprises novel electronics and software (implicit in FIG. 1) which enables the sharing of an incorporated mood stone's color, indicative of a wearer's emotion, over a communications connection 13. It is a purpose of this invention to describe and claim the novel attributes of a mood sensing sharing device 11, including applications of a mood sensing sharing device 11 in the setting of novel jewelry, for example, rings, bracelets, and pendants. Greater detail is provided below regarding these and other aspects of a mood sensing sharing device 11.

A mobile communications apparatus 12 is a smart phone, laptop computer, tablet computer, or other mobile computing device, which has an operating system, such as Apple iOS or Google Android™, and which is capable of executing novel application ("App") software in accordance with the present invention. Greater detail is provided below regarding a mobile communications apparatus 12.

The communications connection 13, of FIG. 1, is a communications channel which may be implemented using a physical medium, for example, an industry standard Universal Serial Bus (USB) data cable, or may be implemented using a wireless medium, for example, a Bluetooth® Low Energy v4.0 conforming connection or an industry standard Wi-Fi® 802.11a connection. In the preferred embodiment of the mood sensing sharing system 10, communications connection 13 is implemented in accordance with the Bluetooth Low Energy v4.0 specification. In another exemplary embodiment, communication connection 13 is a conforming USB cable having a Micro B USB connector on one end and a Standard-A type USB connector on the other end.

The communications network 14, of FIG. 1, is a global system of networks such as the Internet which provides connectivity to billions of user devices. In the preferred embodiment of this invention, the communications network 14 is the Internet and implements standard Internet protocols such as the Hypertext Transfer Protocol (HTTP) and Transmission Control Protocol (TCP).

The communications connection 15, of FIG. 1, is an access connection to communications network 14 of a mood sensing sharing system 10. Many standard access methods are possible, including (but not limited to) dial-up modem access via telephone network circuits, broadband access via coaxial cabling or copper wires, Wi-Fi access, and cellular telephony access via third generation (3G) or fourth generation (4G) wireless networks. Any of these access methods or other standard Internet access methods may be used for communications connection 15 to access communications network 14. In the preferred embodiment of a mood sensing sharing system 10, at least one communications connection 15 is a 4G wireless network connection.

Though the illustration of FIG. 1 suggests that a mood sensing sharing device 11 and a mobile communications apparatus 12 are physically distinct implements, it should be understood that that a mood sensing sharing device 11 may be physically incorporated into a mobile communications apparatus 12, in which case the communications connection 13 is an internal connection of the combined implementation.

Figure 2:
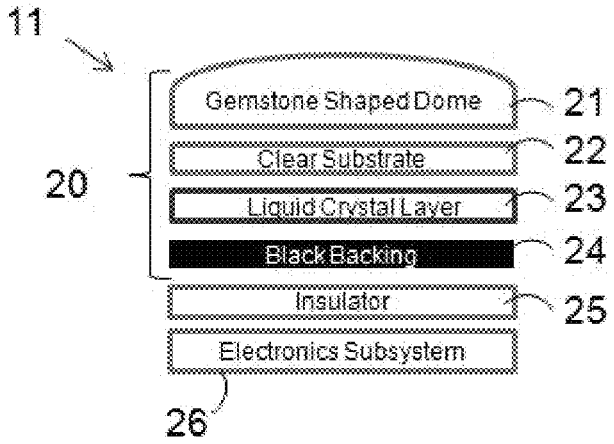
FIG. 2 is a diagram of one implementation of a partially exploded mood sensing sharing device.

FIG. 2 is an exploded view of one implementation of a mood sensing sharing device 11, which is constructed in accordance with the present invention. As shown therein, a mood sensing sharing device 11 comprises a mood stone 20, an insulator 25, and an electronics subsystem 26. Applications of a mood sensing sharing device 11 include the use in novel jewelry, for example, the use in rings, bracelets, and pendants.

The mood stone 20 is a decorative cholesteric stone, of a type taught by U.S. Pat. No. 3,802,945. The mood stone 20 comprises a gemstone shaped clear dome 21, a clear substrate 22, a liquid crystal layer 23, and a black backing 24. Referring to FIG. 2, the preferred embodiment of a mood stone 20 of a mood sensing sharing device 11 has the characteristics listed in TABLE 1.

TABLE 1

| Mood Stone of a Mood Sensing Sharing Device |
| --- |
| The gemstone shaped dome 21 comprises a clear, non-faceted acrylic plastic, which is oval in shape-20 millimeters (mm) wide along its longest axis, 12 mm wide along its shortest axis, and 4 mm in height at its apex.<br>The clear substrate 22 is a clear polyester plastic sheet with an adhesive layer, having a combined thickness of 180 microns.<br>The liquid crystal layer 23 is a microencapsulated thermochromic liquid crystal ink deposited to a thickness of 50 microns on top of a black backing 24.<br>The black backing 24 is a black colored polyester plastic sheet and adhesive layer, which are a combined 180 microns in thickness. |

In another embodiment of a mood stone 20 in a mood sensing sharing device 11, the gemstone shaped dome 21 comprises transparent silicate glass.

The insulator 25 helps to thermally isolate the mood stone 20 from heat generated by the electronics subsystem 26 in a mood sensing sharing device 11. In the preferred embodiment of a mood sensing sharing device 11, the insulator 25 comprises a natural rubber sheet which is 0.5 mm thick. In another exemplary embodiment, of a mood sensing sharing device 11, the insulator 25 is omitted. And, in another exemplary embodiment of a mood sensing sharing device 11, the insulator 25 is colored black and doubles as the black backing 24 of a mood stone 20.

The electronics subsystem 26, of a mood sensing sharing device 11, enables an indication of the color being displayed on a mood stone 20 of the mood sensing sharing device 11 to be shared with a mobile communications apparatus 12, in a mood sensing sharing system 10. The electronics subsystem 26 is discussed in greater detail below.

Figure 3:
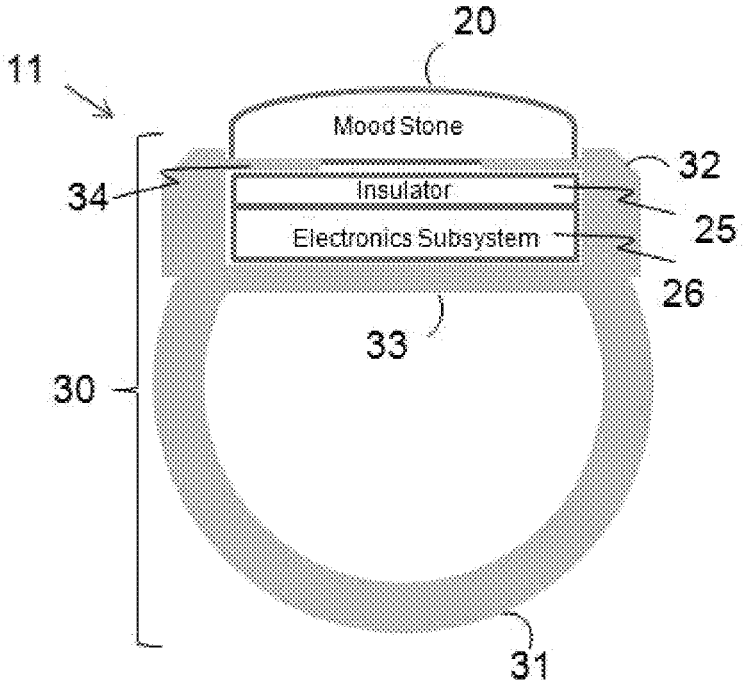
FIG. 3 is a vertical cross section view of a mood sensing sharing device in the setting of a ring.

An objective of the present invention is to provide a new type of mood stone adorned jewelry, for example, a ring, an earring, a bracelet, etc., which enables the sharing of the color state of a mood stone therein, corresponding to the emotional state of the wearer, over a communications connection 13. FIG. 3 is a vertical cross section view of a mood sensing sharing device 11, which is constructed in accordance with the present invention, in the setting 32 of a ring, to form a mood sensing sharing ring 30.

In greater detail, the exemplary mood sensing sharing ring 30, of FIG. 3, comprises a mood stone 20, a band 31, a setting 32, an under bezel 33, a heat conducting material 34, an insulator 25 and an electronics subsystem 26. Referring to FIG. 3, the mood stone 20 is in thermal contact with the setting 32, the band 31 or both, by means of the heat conducting material 34, to ensure that the heat being radiated by a finger, upon which the ring is being worn (implicit in the figure), is readily being transferred to the mood stone 20. The band 31, setting 32, and heat conducting material 34 are comprised of silver, aluminum, stainless steel or some other heat conductive material, which is suitable for the fabrication of jewelry. The insulator 25 isolates the mood stone 20 from heat being generated by the electronics subsystem 26. The electronics subsystem 26 enables an indication of the color being displayed on the mood stone 20 to be shared over a communications connection 13.

Referring to FIG. 3, the preferred embodiment of a mood sensing sharing ring 30 has a band 31, which comprises aluminum; a setting 32, which comprises aluminum; and a heat conducting material 34, which comprises aluminum. The mood stone 20 is a decorative cholesteric stone as taught by U.S. Pat. No. 3,802,945 and as detailed in FIG. 2 and TABLE 1. In the preferred embodiment of a mood sensing sharing ring 30, the insulator 25 comprises silicon rubber. In another exemplary embodiment of a mood sensing sharing ring 30, the insulator 25 is omitted. The electronics subsystem 26 is discussed in greater detail below.

Because skin temperature varies significantly depending on the location where the measurement is taken—for example, the skin temperature measured on a finger will generally be substantially lower than the skin temperature measured on a wrist or on an ear—the formulation of a liquid crystal layer 23, of a mood sensing sharing ring 30, must be adjusted to ensure that a normal core body temperature of 37 degrees Celsius (37° C.) can be indicated by the color green. For mood stones, the color green is commonly believed to indicate a normal, active emotional state; the color black a tense, nervous emotional state; and the color dark blue a happy, passionate emotional state. Consequently, the respective lower end and upper end of the temperature range for the formulated liquid crystal layer 23 of a mood sensing sharing ring 30 should produce the color black (or dark gray) and the color dark blue. Experimentation has revealed that for a normal room temperature of 22° C. and a normal core body temperature of 37° C., the average skin temperature of a finger will be 27° C. Referring to FIG. 3, in the preferred embodiment of a mood sensing sharing ring 30, the liquid crystal layer 23 (implicitly shown in the figure), of the mood stone 20, is formulated to experience its entire spectrum of color change for temperatures ranging between 22° C. and 32° C., with a corresponding sensitivity (and accuracy) of 0.5° C., measurable within 5 seconds, with the color green produced for a temperature of 27° C., the color black produced for a temperature of 22° C., and the color dark blue produced for a temperature of 32° C.

Figure 4:
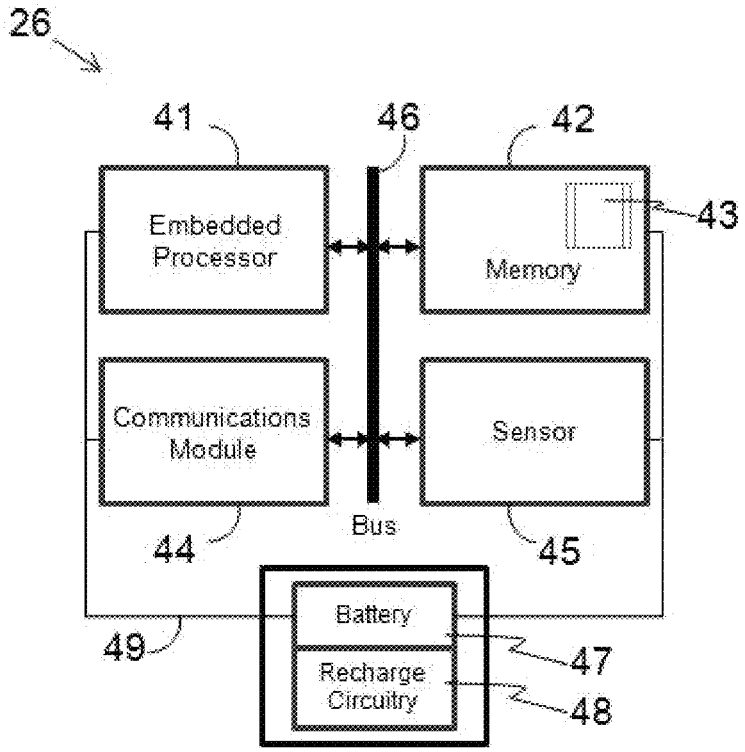
FIG. 4 is a block diagram of an embodiment of the electronics subsystem of a mood sensing sharing device.

FIG. 4. is a block diagram of an embodiment of the electronics subsystem 26, of a mood sensing sharing device 11 (including, for example, in the setting 32 of a mood sensing sharing ring 30), which is constructed in accordance with the present invention. The electronics subsystem 26 enables the color being display on a mood stone 20 of a mood sensing sharing device 11 (implicit in the figure), to be shared via a communications connection 13. Referring to FIG. 4, as there illustrated, an electronics subsystem 26 comprises an embedded processor 41, memory 42, a sensor service routine 43, a communications module 44, a sensor 45, a local processor bus 46, a energy storage device 47, recharge circuitry 48, and a power distribution bus 49, which supplies voltage to all of the integrated circuit components of the electronics subsystem 26.

Referring to FIG. 4, the embedded processor 41 of the electronics subsystem 26, of a mood sensing sharing device 11, is a microprocessor, which acts as the main controller for the electronics subsystem 26. The embedded processor 41 communicates with other components of the electronics subsystem 26 via the local processor bus 46. The embedded processor 41 executes software, including operating system software and a sensor service routine 43, which is resident in the memory 42. Described in greater detail below, the sensor service routine 43 is software which acts on information received from the sensor 45. The embedded processor 41 receives data from sensor 45 via the local processor bus 46. The memory 42 may be internal to the embedded processor 41, or may be external to the embedded processor 41 as shown in FIG. 4. In the preferred embodiment of an electronics subsystem 26, the embedded processor 41 is a low power, mixed signal 16-bit ARM® based micro-controller, having both integrated digital-to-analog and analog-to-digital converters, and the memory 42 is an NAND flash memory module having a density of 256 Megabytes and a having a bus width of 16-bits.

Again referring to FIG. 4, the electronics subsystem 26, of a mood sensing sharing device 11 (implicit in the figure), comprises at least one sensor 45, which for the preferred embodiment is a programmable, low operating current, digital temperature thermometer sensor having the following characteristics: a minimum range of 20° C. to 40° C.; a minimum resolution of 0.5° C.; a minimum accuracy of 0.5° C.; and a response time of less than 1 second. Because a mood stone exhibits temperature dependent iridescence, a temperature reading from the aforementioned temperature sensor can be mapped to the mood stone's color. More generally, other embodiments of the electronics subsystem 26 may contain other sensors, or more than one sensor, which individually, or in combination can be used by the electronics subsystem 26 to discern the color of an accompanying mood stone in a mood sensing sharing device 11. Referring to FIG. 4, in another embodiment of the electronics subsystem 26, the sensor 45 is an analog temperature sensor. In another embodiment of an electronics subsystem 26, the sensor 45 is a digital temperature and humidity sensor. And, in another embodiment of an electronics subsystem 26, the sensor 45 is an optical sensor.

Referring to FIG. 4, the communications module 44 is an integrated circuit based hardware and software module, which facilitates the provision of a communications connection 13 for the sharing of the color of a mood stone 20 of a mood sensing sharing device 11 via a communications network. Generally, a communications connection 13 may be implemented using a physical medium, for example, an industry standard Universal Serial Bus (USB) data cable, or may be implemented using a wireless medium, for example, a Bluetooth Low Energy (BLE) conforming connection or an industry standard Wi-Fi 802.11b connection. In the preferred embodiment of an electronics subsystem 26, the communications module 44 is a low power, BLE v4.0 specification compliant integrated circuit and software module, which minimally supports the advertising and slave peripheral device roles of the BLE Generic Access Profile (GAP) and the peripheral Generic Attribute Profile (GATT) Server role. In another embodiment of an electronics subsystem 26, the communications module 44 comprises USB compliant circuitry and supporting software.

Components of the electronics subsystem 26 of FIG. 4 are powered by a battery 47, with an accompanying recharge circuitry 48, via the power distribution bus 49. Generally, a battery 47 may comprise several distinct chemistries. In the preferred embodiment of an electronics subsystem 26, the battery 47 is a button cell, which comprises Nickel Metal-Hydride (Ni-MH) rechargeable cells and which collectively supply 5 volts over the power distribution bus 49. In another embodiment of an electronics subsystem 26, the battery comprises Nickel-Cadmium (Ni—Cd) cells. In another embodiment of an electronics subsystem 26, the battery 47 comprises a Lithium Ion (Li-Ion) rechargeable button cell, which supplies 5 volts over the power distribution bus 49.

Referring to FIG. 4, the recharge circuitry 48, of the electronics subsystem 26, provides a charging current, which charges the battery 47. Generally, the recharge circuitry 48 provides both slow (trickle) charging and fast charging. A current generation mechanism, which is either internal to or external to the recharge circuitry 48, supplies the charge current, and a capacitor, which is an integral part of the recharge circuitry 48, temporarily stores the generated charge, so that it is available to a battery 47 via a conductive wire when recharging is necessary. In an embodiment of the recharge circuitry 48, the current generation mechanism comprises an internal weight system, which generates a magnetic field which induces current flow in an accompanying wire in response to movements of the electronics subsystem 26 within a mood sensing sharing device 11. In another embodiment of the recharge circuitry 48, the current generation mechanism comprises an internal weight system, which is coupled to a micro-motor which generates current flow in an accompanying wire in response to movements of the electronics subsystem 26 within a mood sensing sharing device 11. In another embodiment of the recharge circuitry 48, the current generation mechanism comprises an internal heat sensitive semiconductor, which induces current flow in an accompanying wire in response to warming of the recharge circuitry 48 as the mood sensing sharing device 11 is being worn. In the preferred embodiment of the recharge circuitry 48, the current generation mechanism is an external USB power adapter, whereby the adapter plugs into an AC outlet and a USB cable connects the USB adapter to the recharge circuitry 48.

Small physical size, low power consumption, and low cost are desired characteristics for any implementation of an electronics subsystem 26, given an intended use as part of a mood sensing sharing device 11 in the setting 32 of a piece of jewelry. Referring to FIG. 4, in the preferred embodiment of the electronics subsystem 26, components therein are implemented as a mixed signal system-on-a-chip (SoC), comprising a single chip substrate, as an application specific integrated circuit (ASIC), using a 65 nm technology process. In other embodiments of the electronics subsystem 21, components therein are implemented in a system-in-a-package (SiP), comprising multiple chips in a chip carrier, as an ASIC or field programmable gate array (FPGA), using a 65 nm or other size technology process.

As previously discussed, the memory 43 module supports the embedded processor 41 module's software execution, including the temporary storage of sensor information and of messages exchanged between the embedded processor 41, under the direction of sensor service routine 43, and an external application, which is running on a paired communications apparatus 12 in a mood sensing sharing system 10. The sensor service routine 43 is software, executing within a Linux based embedded operating system for example, which enables the color being displayed on a mood stone 20, reflecting the wearer's mood, to be shared with at least one mobile communications apparatus 12. Referring to FIG. 4, the sensor service routine 43, of the electronics subsystem 26, of a mood sensing sharing device 11 (implicit in the figure), provides the following functions: the establishment of a communications connection 13, through a communications module 44, using existing connection setup protocols; the characterization of information from a sensor 45 to determine the color of a mood stone 20 of a mood sensing sharing device 11; and the sending of an indication of the color of a mood stone 20 of the mood sensing sharing device 11 over a communications connection 13. In the preferred embodiment of an electronics subsystem 26, the sensor service routine 43 uses a look-up table to map the reading from a sensor 45 to the RGB color model number of the color being displayed on the mood stone 20 of the mood sensing sharing device 11. The RGB color number is the indication of color that is sent to a custom application, referred to below as a mood sensing sharing application, running on paired mobile communications apparatus 12, by means of a communications connection 13. In the preferred embodiment of an electronics subsystem 26, the connection setup protocols, for a communications connection 13, comprise the BLE slave peripheral GAP and GATT semantics and procedures.

Figure 5:
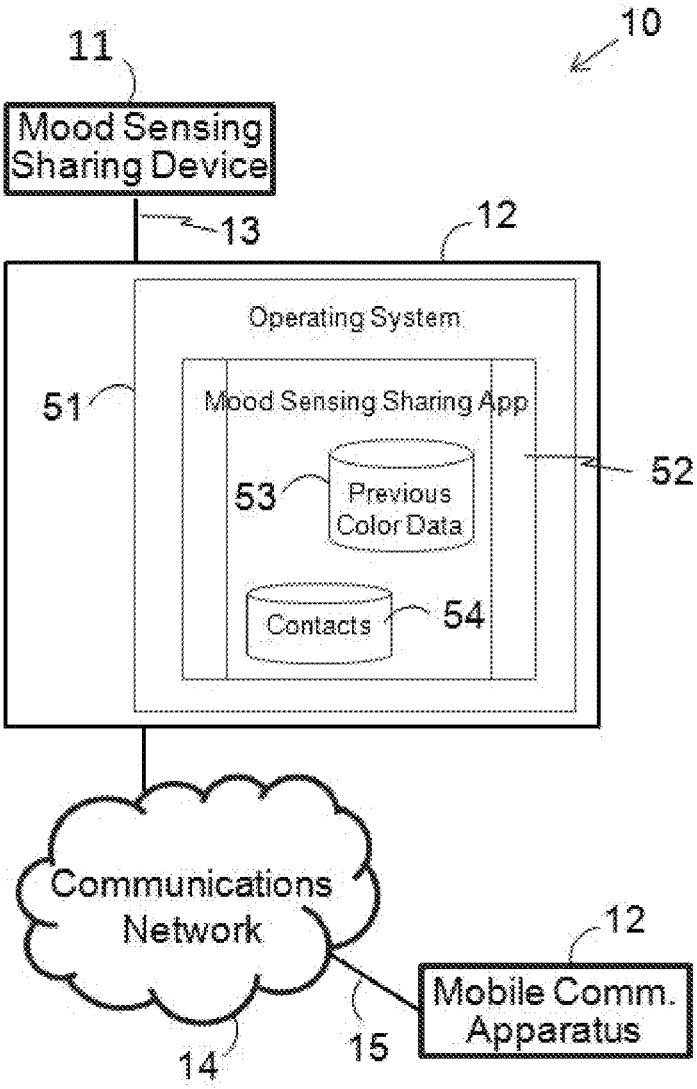
FIG. 5 illustrates the operating environment and major data structures for a mood sensing sharing application of a mobile communications apparatus in a mood sensing sharing system.

FIG. 5 illustrates the operating environment and major data structures for a mood sensing sharing application 52 of a mobile communications apparatus 12 in a mood sensing sharing system 10. Generally, a mobile communications apparatus 12 is a computing platform in the form of a smart phone, tablet computer, personal computer, or other similar device. Regarding the present invention, relevant aspects of a mobile communications apparatus 12 include a central processing core, memory modules, input-output modules, and a mobile operating system 51, such as Google Android or an Apple iOS. Referring to FIG. 5, a mobile communications apparatus 12, in accordance with the present invention, additionally comprises a mood sensing sharing application 52, executing within the mobile operating system 51. A mood sensing sharing application 52 is custom software which enables a mobile communications apparatus 12 to pair with a mood sensing sharing device 11, by means of a communications connection 13, in order to receive color information for a mood stone 20 of the paired mood sensing sharing device 11. A mood sensing sharing application 52, of a mobile communications apparatus 12, provides the following functions: the establishment of communications connections 13 with mood sensing sharing devices 11, using one or more existing connection setup protocols; the identification of mood sensing sharing devices 11 by means of a unique identifier; and the receiving of an indication of the color for a mood stone 20 of an identified mood sensing sharing device 11 over said communications connection. In the preferred embodiment of a mood sensing sharing application 52, the pairing processes between the mood sensing sharing application 52 and a mood sensing sharing device 11 uses BLE v4.0 protocols and procedures. In the preferred embodiment of a mood sensing sharing application 12, the identifier used to uniquely identify a mood sensing sharing device 11 is a device identifier comprising a string of twenty-five (25) alpha numeric characters. In the preferred embodiment of a mobile communications apparatus 12, the mood sensing sharing application 52 receives an indication of color in the form of the RGB color model number corresponding to the color being displayed on the mood stone 20 of a paired mood sensing sharing device 11. Referring to FIG. 5, in one embodiment of a mood sensing sharing application 52, the mood sensing sharing application 52 additionally compares a newly received color indication for a mood stone 20, of a paired mood sensing sharing device 11, to previously received color indications stored in the previous color data 53 data structure and if the newly received color indication differs from the previously received color indications therein, then the newly received color indication is sent to other mobile communications apparatuses 12, identified in the contacts 54 list, via a communications network 14.

While in the foregoing, there have been described specific apparatuses and methods for the present invention, it is to be clearly understood that the provided description is exemplary and is not to limit the scope of the invention, but on the contrary, is intended to cover various modifications included within the spirit and scope of the appended claims.

I claim:

1. A mood sensing sharing device, in a setting of decorative jewelry, the device comprising:

at least one heat sensitive cholesteric stone, visible in said setting, the cholesteric stone color responsive to skin temperature changes, and an electronics subsystem;

the electronics subsystem having a sensor which is distinct from said cholesteric stone and which is capable of determining the color of said heat sensitive cholesteric stone, the electronics subsystem having a communications module for connecting to a communications apparatus, which is capable of receiving color information for a cholesteric stone, over a communications network, and the electronics subsystem having a capability to send color information for said heat sensitive cholesteric stone to said communications apparatus over said communications network.

2. The mood sensing sharing device of claim 1, wherein the mood sensing sharing device is in the setting of a jewelry ring.

3. The mood sensing sharing device of claim 1, wherein the mood sensing sharing device is in the setting of a jewelry bracelet.

4. The mood sensing sharing device of claim 1, wherein the mood sensing sharing device is in the setting of a jewelry pendant.

5. The mood sensing sharing device of claim 1, wherein the mood sensing sharing device is in the setting of a jewelry earrings.

* * * * *